US009254520B2

(12) United States Patent
Dittenberger et al.

(10) Patent No.: US 9,254,520 B2
(45) Date of Patent: Feb. 9, 2016

(54) PROCESS ENGINEERING MEASURES IN A CONTINUOUS CASTING MACHINE AT THE START OF CASTING, AT THE END OF CASTING AND WHEN PRODUCING A TRANSITIONAL PIECE

(71) Applicant: SIEMENS VAI METALS TECHNOLOGIES GMBH, Linz (AT)

(72) Inventors: Kurt Dittenberger, Leonding (AT); Udo Feischl, Reichenau im Muehlkreis (AT); Klemens Hauser, Pucking (AT); Wolfgang Kibler, Gallneukirchen (AT); Paul Pennerstorfer, Thalheim/Wels (AT); Franz Ramstorfer, Zistersdorf (AT)

(73) Assignee: SIEMENS VAI METALS TECHNOLOGIES GMBH (AT)

( * ) Notice: Subject to any disclaimer, the term of this patent is extended or adjusted under 35 U.S.C. 154(b) by 0 days.

(21) Appl. No.: 14/361,284

(22) PCT Filed: Nov. 19, 2012

(86) PCT No.: PCT/EP2012/072959

§ 371 (c)(1),
(2) Date: May 28, 2014

(87) PCT Pub. No.: WO2013/083391

PCT Pub. Date: Jun. 13, 2013

(65) Prior Publication Data

US 2014/0290899 A1 Oct. 2, 2014

(30) Foreign Application Priority Data

Dec. 5, 2011 (AT) ..... A1792/2011

(51) Int. Cl.
*B22D 11/08* (2006.01)
*B22D 11/16* (2006.01)

(Continued)

(52) U.S. Cl.
CPC ..... *B22D 11/081* (2013.01); *B22D 11/04* (2013.01); *B22D 11/161* (2013.01); *B22D 11/208* (2013.01); *B22D 11/225* (2013.01)

(58) Field of Classification Search
CPC .... B22D 11/04; B22D 11/081; B22D 11/161; B22D 11/208; B22D 11/225
USPC ..... 164/454, 455, 462, 484, 486, 425, 442, 164/444, 445, 448, 413, 414
See application file for complete search history.

(56) References Cited

U.S. PATENT DOCUMENTS 3,417,810 A 12/1968 Tiskus et al.
3,584,677 A * 6/1971 Hammerton ..... 164/483

(Continued)

FOREIGN PATENT DOCUMENTS

DE 101 60 636 A1 7/2002
EP 0 234 491 A2 9/1987

(Continued)

OTHER PUBLICATIONS

International Search Report with Form PTO-1449 dated Mar. 25, 2013 issued in corresponding International patent application No. PCT/EP2012/072959.

*Primary Examiner* — Kevin P Kerns
(74) *Attorney, Agent, or Firm* — Ostrolenk Faber LLP

(57) ABSTRACT

A method for operating a continuous casting machine (1) at the start of casting, at the end of casting and when producing a transitional piece (21) for improving the quality of the ends of the strand (16, 18), and protecting the machine from damage. At the start of casting, perform the following additional method steps: recording a position of the beginning of the strand (16) in the strand guide (4); after the beginning of the strand (16) and after an upper end (17*a*) of the beginning region of the strand (17), has passed a pair of adjustable strand guiding rollers (5) adjusting the roller pair to touch the strand (2); cooling the beginning region of the strand (17) by the cooling nozzle (10) delivering an amount of coolant Q less than a nominal amount of coolant $Q_{nom}$ to the beginning region of the strand (17); and cooling the main part of the strand (20) by the cooling nozzle (10) delivering an amount of coolant Q that is substantially equal to $Q_{nom}$ to the main part of the strand (20).

9 Claims, 4 Drawing Sheets

(51) Int. Cl.

| | |
|---|---|
| ***B22D 11/20*** | (2006.01) |
| ***B22D 11/22*** | (2006.01) |
| ***B22D 11/04*** | (2006.01) |

(56) References Cited

U.S. PATENT DOCUMENTS

| | | | | | |
|---|---|---|---|---|---|
| 4,169,498 | A | | 10/1979 | Wilhelm | |
| 4,313,487 | A | * | 2/1982 | Hashio et al. | 164/436 |
| 4,317,482 | A | | 3/1982 | Wolf | |
| 4,729,420 | A | | 3/1988 | Flemming et al. | |
| 4,774,999 | A | * | 10/1988 | Kraus | 164/453 |
| 4,899,801 | A | * | 2/1990 | Ambo | 164/122.1 |
| 5,657,814 | A | * | 8/1997 | Maebara et al. | 164/452 |
| 6,386,268 | B1 | | 5/2002 | Weyer et al. | |
| 6,779,587 | B2 | | 8/2004 | Weyer et al. | |
| 2002/0036074 | A1 | * | 3/2002 | Shay et al. | 164/483 |
| 2008/0264598 | A1 | * | 10/2008 | Morales et al. | 164/452 |
| 2011/0213486 | A1 | | 9/2011 | Plociennik | |

FOREIGN PATENT DOCUMENTS

| | | | |
|---|---|---|---|
| EP | 0 903 192 | A1 | 3/1999 |
| EP | 1 697 070 | | 5/2009 |
| FR | 1 428 473 | | 2/1966 |
| WO | WO 99/46071 | A1 | 9/1999 |
| WO | WO 01/94051 | A1 | 12/2001 |
| WO | WO 2010/051981 | A1 | 5/2010 |

* cited by examiner 1
2
3
4
5
6
7
8
9
10
15
16
17
17a
2,20
x
A 15
3
2
5
10
8
9
15,18
19
5
19a
20
8
40
19
18
10
5

3
2
4
10
8
9
15
5
24a
24
20a
24b
20b

PROCESS ENGINEERING MEASURES IN A CONTINUOUS CASTING MACHINE AT THE START OF CASTING, AT THE END OF CASTING AND WHEN PRODUCING A TRANSITIONAL PIECE

CROSS-REFERENCE TO RELATED APPLICATIONS

The present application is a 35 U.S.C. §§371 national phase conversion of PCT/EP2012/072959, filed Nov. 19, 2012, which claims priority of Austrian Patent Application No. A1792/2011, filed Dec. 5, 2011, the contents of which are incorporated by reference herein. The PCT International Application was published in the German language.

TECHNICAL FIELD

The present invention relates to a respective method for operating a continuous casting machine at the start of casting, at the end of casting and when there is a temporary slowing down of the casting operation.

The term continuous casting machine covers all casting machines that are suitable for the continuous production of a strand with a long or flat product cross-section from a molten steel.

PRIOR ART

It is known that the operation of a continuous casting machine at the start of casting and at the end of casting requires special measures in order to protect the machine from overload and damage.

It is known from U.S. Pat. No. 6,779,587 B2 to switch over from a positioning control to a pressure control in the case where a maximum adjusting force is exceeded when adjusting adjustable strand guiding rollers against a strand. This is intended to prevent the strand guide from being damaged by the dummy bar at the start of casting. Since, according to the document, the cooling is not changed at the start of casting in comparison with nominal operation, the beginning of the strand or the end of the strand is cooled "too hard" (i.e. the ends of the strand are distinctly colder than the strand lying in between). As a result, the quality of the two ends of the strand is reduced, so that these parts must typically be cut off before a subsequent rolling operation. Ultimately, this results in lower productivity of the continuous casting machine and additional effort in the further processing of the strand.

It is known from U.S. Pat. No. 4,317,482 to monitor the strand withdrawal forces continuously in a continuous casting machine, in order to prevent damage to the continuous casting machine or an escape of liquid metal ("spill-out") from the partially solidified strand. As a result, the operating team is indeed informed of imminent problems in the continuous casting machine; but how these problems can be preventively averted cannot be learned from the document however.

EP 1 697 070 B1 discloses measures for changing a tundish, in order to keep down the amount of foreign particles that enter the strand. Furthermore, the casting speed is reduced when changing the tundish, with a so-called transitional piece being formed.

Actual instructions as to which measures should be taken to protect the continuous casting machine at the start of casting, at the end of casting and when creating a transitional piece cannot be learned from the above documents.

SUMMARY OF THE INVENTION

Technical Problem

The term continuous casting machine covers all casting machines that are suitable for the continuous production of a strand with a long or flat product cross section from a molten steel.

In this application, an adjustable strand guiding roller is intended to mean both an individually adjustable strand guiding roller (see for example WO2011/095383), a strand guiding roller of a strand guiding segment that is adjusted by the inclination of the clamping cylinders of the segment, or a strand guiding roller that is adjusted against the strand by one (see for example WO01/94051) or two adjusting cylinders.

The problem addressed by the invention is overcoming the disadvantages of the prior art and presenting a respective operating method for a continuous casting machine at the start of casting, at the end of casting and when slowing down the casting operation, with which

- the quality of the ends of the strand (the beginning of the strand and the end of the strand) is improved, and
- the continuous casting machine is preventively protected from damage when the method is used.

Technical Solution

This problem is solved by a method herein disclosed. Advantageous effects of the invention are disclosed.

The continuous casting machine comprises a mold and a strand guide. The strand guide comprises at least one pair of adjustable strand guiding rollers and at least one cooling nozzle. The invention also relates to a method for operating a continuous casting machine at the start of casting having the following method steps:

- introducing a dummy bar into the continuous casting machine;
- holding the dummy bar in the strand guide, such that a dummy bar head closes off the mold in a fluid-tight manner;
- starting the casting of the continuous casting machine, by pouring liquid steel into the mold and thereby forming an at least partially solidified strand, having a beginning of the strand, a following beginning region of the strand with a length A, $0.5<A<5$ m, and thereafter a main part of the strand; and
- withdrawing the dummy bar from the mold in a casting direction.

A method for operating a continuous casting machine at the start of casting, of the type mentioned at the beginning, includes the additional method steps of:

- recording a position of the beginning of the strand in the strand guide;
- after the beginning of the strand, preferably an upper end of the beginning region of the strand, has passed the pair of adjustable strand guiding rollers: adjusting the pair of guiding rollers against the strand, so that the pair of guiding rollers is touching the strand;
- cooling the beginning region of the strand with $Q<Q_{nom}$, wherein the cooling nozzle delivers an amount of coolant Q that is less than a nominal amount of coolant $Q_{nom}$ to the beginning region of the strand;
- cooling the main part of the strand with $Q\approx Q_{nom}$, wherein the cooling nozzle delivers an amount of coolant Q that is substantially equal to $Q_{nom}$ to the main part of the strand.

The invention is based on the finding that the ends of the strand, i.e. the beginning of the strand and the end of the strand, are colder than the strand lying in between (hereafter also referred to as the main part of the strand), which is cast continuously under nominal casting conditions. This is brought about in particular by the reduced casting speed at the start of casting and the end of casting. In addition, heat is removed by way of the casting strand or by the water that additionally gets onto the end of the strand or the strand end plate, i.e. the end face of the end of the strand. Because of the lower temperature, the ends of the strand are generally completely solidified through. If these two cold and solidified-through ends of the strand are transported through the machine, greatly increased roller forces may occur in particular in the bending and straightening zones (i.e. in the zones where the strand is bent from the vertical into the arcuate shape and from the arcuate shape into the horizontal), caused by the contact of individual rollers (or at least a small number of rollers) with these parts of the strand (instead of contact of several rollers in one region, so that there is a distribution of the forces). The roller forces may lie well above the maximum permissible values for the roller bearings, and consequently lead to damage to the rollers or the roller bearings.

According to the invention, after introducing the dummy bar, holding the dummy bar and starting the casting of the continuous casting machine, the position of the dummy bar head or of the beginning of the strand—which is opposite from the dummy bar head—is recorded ("tracked") continuously over time or at discrete time intervals (for example at defined sampling times) during the withdrawal of the dummy bar (or of the strand, since of course the strand is connected to the dummy bar) in the strand guide. Once the beginning of the strand, or preferably the upper end of the beginning region of the strand, with a length of A, $0.5<A<5$ m, has passed a pair of adjustable strand guiding rollers, the roller pair is adjusted against the strand, so that the roller pair is touching the strand. Furthermore, the beginning region of the strand is cooled to a lesser extent by a cooling nozzle than the main part of the strand, which follows on from the beginning region of the strand. In particular, the beginning region of the strand is cooled with an amount of coolant $Q<Q_{nom}$ and the main part of the strand is cooled with an amount of coolant $Q\approx Q_{nom}$. Consequently, the beginning of the strand is, to use the terminology of the art, "cooled more softly" than the main part of the strand. As a result, the temperature of the beginning region of the strand corresponds more to the temperature of the main part of the strand, which is cast continuously under nominal casting conditions. Preferably, only once the beginning of the strand is at a distance of typically several meters in the casting direction from a pair of the opposing strand guiding rollers, the pair of opposing strand guiding rollers is adjusted against the strand and the strand is cooled by at least one cooling nozzle in the region of the pair of adjusted strand guiding rollers with the nominal amount of coolant $Q_{nom}$. At the start of casting, the actual casting gap between the strand guiding rollers and the strand is not used directly at the beginning of the strand, as is technically customary. Instead, only several meters after the beginning of the strand has the effect of avoiding undesired contact of the rollers with the dummy bar and the soft reduction is not used on the cold, and therefore very hard, beginning region of the strand. Since the strand guiding rollers consequently do not touch the beginning region of the strand, on the one hand the further cooling of the strand by the typically cooled rollers is avoided, and on the other hand, damage to the rollers by the beginning region of the strand is preventatively and reliably avoided.

Preferably, the nominal amount of coolant $Q_{nom}$ is dependent on the casting speed, the age of the strand or, with particular preference, the location-dependent temperature of the strand. In the case of an amount of coolant that is dependent on the casting speed, $Q_{nom}$ is less for a lower casting speed than for a higher casting speed. In the case of a nominal amount of coolant $Q_{nom}$ that is dependent on the temperature of the strand, the temperature of the strand may be determined either by measurement (for example by means of a pyrometer) or by online simulation of the temperature of the strand (for example by the software package Dynacs or Dynacs 3D).

It is advantageous that the amount of coolant Q delivered by the cooling nozzle to the beginning region of the strand is increased in dependence on a distance between the beginning of the strand and the cooling nozzle, where $Q\leq Q_{nom}$. Increasing the amount of coolant has the effect that the temperature of the beginning of the strand or the beginning region of the strand is to a certain extent adapted uniformly to the temperature of the main part of the strand, which is cast continuously under nominal casting conditions. The increase in the amount of coolant may take place either continuously or in discrete steps. The distance is understood as meaning the difference between the so-called metallurgical lengths.

In order particularly to avoid segregations in the strand, it is advantageous if the strand is reduced in its thickness by adjusting the pair of adjustable strand guiding rollers against the strand.

It is particularly advantageous if the strand has a liquid core during the reduction of its thickness. One of the effects of this is that the forces during the reduction are also reduced.

The problem addressed by the invention is likewise solved by a method disclosed herein. The invention relates to a method for operating the continuous casting machine at the end of casting having the following method steps:

- continuously casting a strand, by liquid steel being cast in the mold to form an at least partially solidified strand;
- stopping the feeding of liquid steel into the mold, whereby an end of the strand forms in the mold, and so that the strand has an end of the strand, a following end region of the strand with a length B, $0.5<B<5$ m, and thereafter a main part of the strand; and
- withdrawing the strand from the mold in the casting direction.

A method for operating a continuous casting machine at the end of casting, of the type mentioned, includes the additional method steps of:

- recording a position of the end of the strand in the strand guide;
- before the end of the strand, preferably a lower end of the end region of the strand, has passed the pair of adjustable strand guiding rollers: retracting the pair of adjustable strand guiding rollers, so that the pair of rollers is not touching the strand;
- cooling the main part of the strand with $Q\approx Q_{nom}$, the cooling nozzle delivering an amount of coolant Q that is substantially equal to a nominal amount of coolant $Q_{nom}$ to the main part of the strand;
- cooling the end region of the strand with $Q<Q_{nom}$, the cooling nozzle delivering an amount of coolant $Q<Q_{nom}$ to the end region of the strand;
- cooling the end of the strand with $Q\geq Q_{nom}$, the cooling nozzle delivering an amount of coolant $Q\geq Q_{nom}$ to the end of the strand.

Initiating the end of casting has the effect that an end of the strand is formed in the mold that is followed in the casting direction by an end region of the strand with a length B and a main part of the strand. At least once the end of casting has been initiated and the feeding of liquid steel into the mold has been stopped, for example by closing a tundish plug, the position of the end of the strand in the strand guide is in turn recorded. In order to avoid damage to a pair of adjustable strand guiding rollers, the pair of adjustable strand guiding rollers is retracted from the strand before the end of the strand, preferably a lower end of the end region of the strand, has passed the pair, so that the two strand guiding rollers are no longer touching the strand (in positive terms, this means that both strand guiding rollers are at a distance from the surface of the strand). The main part of the strand is cooled substantially with the nominal amount of coolant $Q_{nom}$. The end region of the strand is cooled with an amount of coolant $Q<Q_{nom}$ and the end of the strand is cooled with an amount of coolant $Q\geq Q_{nom}$. The less intense cooling of the end region of the strand has the effect that the temperature of this region is adapted more to the temperature of the main part of the strand, so that the quality is improved. The intense cooling of the end of the strand ensures that the end plate of the strand is solidified through completely, so that no liquid metal can escape. For many grades of steel, it is sufficient to use the intense cooling of the end of the strand only in the first cooling zones (for example cooling zones 1 to 3 directly after the mold).

In order to achieve a temperature of the end region of the strand that is as uniform as possible, it is advantageous if, during the cooling of the end region of the strand, the amount of coolant Q delivered by the cooling nozzle is reduced in dependence on a distance between the end of the strand and the cooling nozzle, where $0<Q<Q_{nom}$.

In order to avoid a "spill-out" at the end of casting, it is advantageous if, during the cooling of the end of the strand, the cooling nozzle delivers a maximum amount of coolant $Q=Q_{max}$ to the strand. As a result, the end plate is subjected to the maximum flow rate of water—at least in the first three cooling zones of the strand guide—so that a "spill-out" is reliably prevented.

In order to reduce the water consumption, or hinder the undesired cooling of the strand by cooling water dripping down, it is advantageous to end the cooling by the cooling nozzle after the end of the strand has passed the cooling nozzle.

The invention also relates to a method for operating a continuous casting machine when there is a temporary slowing down of the casting operation (for example in the course of a ladle change), having the following method steps:

- continuously casting a strand, by liquid steel being cast in the mold to form an at least partially solidified strand;
- withdrawing the strand at a rate v from the mold in a casting direction, with v substantially equal to a nominal rate $v_{nom}$;
- reducing a feeding rate of liquid steel into the mold, whereby the formation of a transitional piece begins;
- withdrawing the strand at $v<v_{nom}$;
- increasing the feeding rate of liquid steel into the mold, whereby the formation of a transitional piece is ended, so that the strand has a lower main part of the strand, a transitional piece and an upper main part of the strand;
- withdrawing the strand at $v\approx v_{nom}$.

A method for operating a continuous casting machine when there is a temporary slowing down of the casting operation, of the type mentioned at the beginning, has the additional method steps of:

- recording the positions of a lower end and an upper end of the transitional piece in the strand guide;
- before the lower end of the transitional piece has passed the pair of adjustable strand guiding rollers: retracting the pair of adjustable strand guiding rollers from the strand, so that the pair is not touching the transitional piece;
- once the upper end of the transitional piece has passed the pair of adjustable strand guiding rollers: adjusting the pair of adjustable strand guiding rollers against the strand, so that the pair is touching the strand;
- cooling a main part of the strand with $Q\approx Q_{nom}$, the cooling nozzle delivering an amount of coolant Q that is substantially equal to a nominal amount of coolant $Q_{nom}$ to the main part of the strand;
- cooling the transitional piece with $Q<Q_{nom}$, the cooling nozzle delivering an amount of coolant $Q<Q_{nom}$ to the transitional piece.

Reducing the amount of liquid steel that is fed, and the reduction in the strand withdrawal rate—resulting on account of continuity—has the effect of producing a so-called transitional piece in the strand, which is distinctly colder than the main part of the strand. Damage to the strand guide is prevented by a pair of adjustable strand guiding rollers being retracted before passing the transitional piece, so that the strand guiding rollers are not touching the transitional piece. After passing the transitional piece, the pair is adjusted again against the strand, so that the rollers of the pair are touching the strand. The fact that the transitional piece is cooled less intensely ("more softly") than the main parts of the strand means that the temperatures of the transitional piece and of the main parts of the strand are at least partially adapted. As a result, the quality of the transitional piece is increased.

BRIEF DESCRIPTION OF THE DRAWINGS

Further advantages and features of the present invention emerge from the description below of non-restrictive exemplary embodiments, reference being made to the following figures, in which.

DESCRIPTION OF THE EMBODIMENTS

Figures 1A, 1B, 1C, 1D:
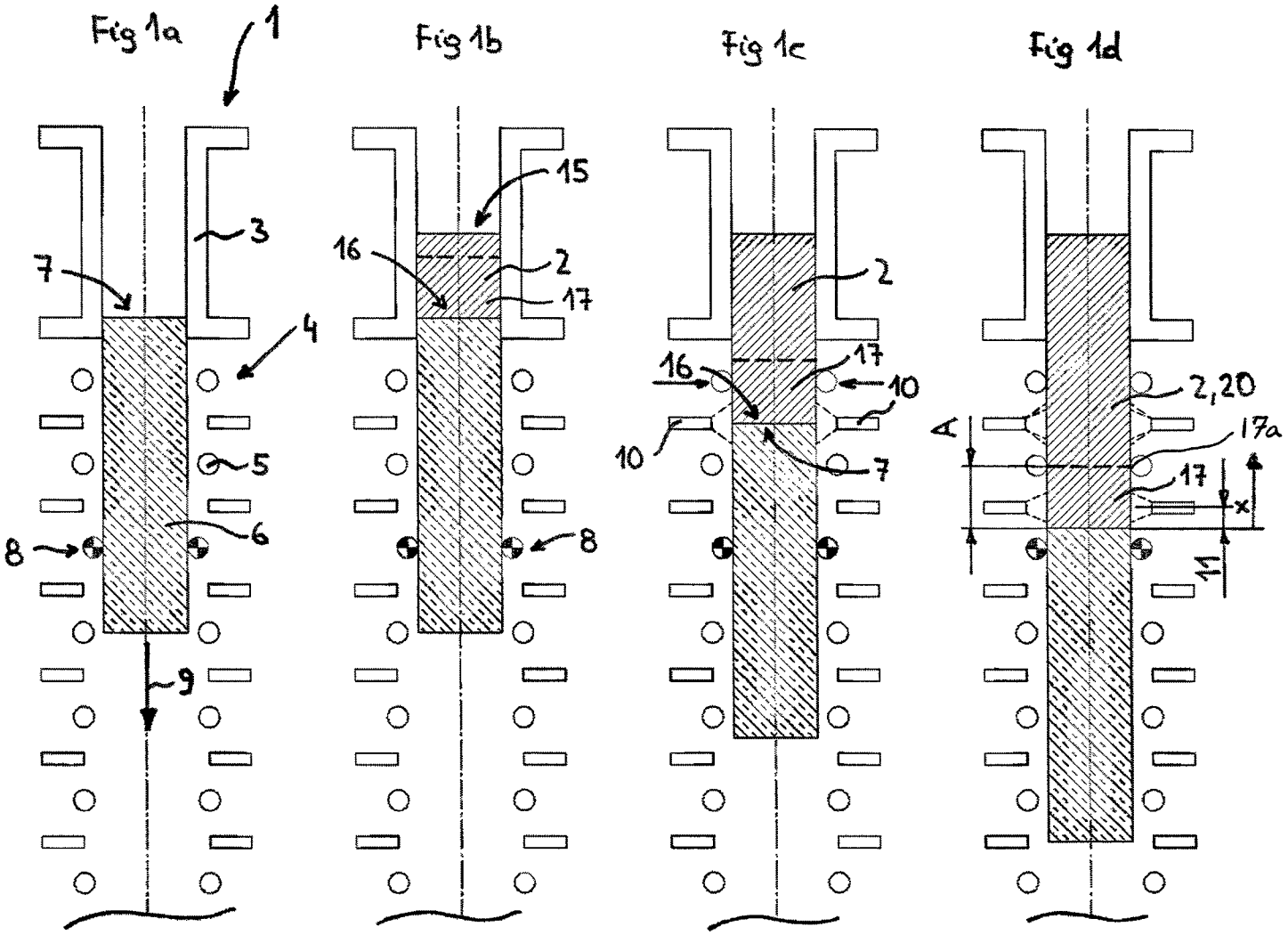
FIG. 1 shows a schematic representation of the method according to the invention at the start of casting, wherein the different phases are represented in FIGS. 1*a* to 1*d;*

FIG. 1 shows the method according to the invention for operating a continuous casting machine at the start of casting. The method steps are represented more specifically in FIGS. 1*a* to 1*d*. The continuous casting machine 1 is in this case configured as a vertical continuous casting machine with a cooled open-ended mold 3, which is designed for the continuous casting of liquid steel to form a strand 2 with the profile cross section of a billet or bloom. The strand guide 4 has a number of pairs of strand guiding rollers 5, which can be adjusted opposite one another against the strand 2, and a number of cooling nozzles 10. In a continuous casting operation, liquid steel is filled into the mold 3 by means of a submerged entry nozzle (not represented), where the molten steel is cooled by a so-called primary cooling and a partially solidified strand 2 with a thin strand shell thereby forms.

FIG. 1*a* shows the situation before the beginning of casting, which in this application is referred to as the start of casting. Once a dummy bar 6 has been introduced into the mold 3 from above, the dummy bar 6 is held in the strand guide 4, for example by drivable strand guiding rollers 8, so that the head of the dummy bar (the dummy bar head 7) seals the mold in a fluid-tight manner.

FIG. 1*b* shows the situation when beginning the casting of the continuous casting machine 1. A tundish (not shown) fills molten steel into the mold 3 via a submerged entry nozzle (SEN), and a liquid metal level (the so-called meniscus 15) is established in the mold. The cooling of the molten metal in the mold 3 has the effect that there forms a partially solidified strand 2, which has a beginning of the strand 16, a beginning region of the strand 17 with a length A, and a main part of the strand 20. At the contact area between the dummy bar head 7 and the strand 2 there forms the beginning of the strand 16, which is fused with the dummy bar head 7. Counter to the casting direction 9, the beginning of the strand 16 is followed by the beginning region of the strand 17, and the beginning region of the strand 17 is followed by the main part of the strand 20. The at least partially solidified strand 2 is withdrawn from the mold 3 and cooled further by means of the cooling nozzles 10 of the secondary cooling. In the case of this exemplary embodiment, the beginning region of the strand has a length A of 3 m.

FIG. 1*c* shows the situation when withdrawing the dummy bar 6 from the mold 3. The liquid metal level 15 in the mold is kept approximately constant by the feeding of molten steel, so that the withdrawal in the casting direction 9 has the effect that the dummy bar 6—which is connected to the strand 2—is also withdrawn from the mold by the drivable strand guiding rollers 8. It is decisive for the further method steps that the position of the dummy bar head 7 or the position of the beginning of the strand 16 in the strand guide is recorded. This takes place, for example, by a rotary encoder, which is connected to an adjusted, driven strand guiding roller 8. However, a person skilled in the art is also familiar with other possible ways in which the position of the dummy bar head can be recorded or "tracked". Once the beginning of the strand 16 has passed a pair of adjustable strand guiding rollers 5, the pair 5 of opposing strand guiding rollers is adjusted against the strand 2. In FIG. 1*c*, this is in fact the case with the two uppermost strand guiding rollers 5, their adjustment against the strand 2 having been indicated by a respective arrow. It can also be seen in this figure that the uppermost pair of cooling nozzles 10 delivers a reduced amount of coolant $Q<Q_{nom}$ of the cooling medium water to the beginning region of the strand 17. The reduced amount of coolant is represented in the figures by a thin coolant jet. The beginning region of the strand 17 is defined by the beginning of the strand 16 and by the length A.

FIG. 1*d* shows a further situation at the start of casting, the strand 2 having been withdrawn further from the mold 3. In fact, the beginning of the strand 16 has passed the two uppermost pairs of strand guiding rollers 5, so that both pairs have been adjusted against the strand 2. The beginning region of the strand 17 with a length of A=3 m, which is cooled with a reduced amount of coolant, is likewise depicted. The uppermost cooling nozzle 10 already lies outside the beginning region of the strand 17, so that the main part of the strand 20 of the strand 2 is cooled with the nominal amount of coolant $Q_{nom}$, which in the specific case is dependent on the casting speed. The delivery of the nominal amount of coolant is represented in the figures by a wide coolant jet.

According to an alternative method, the adjustable strand guiding rollers 5 are not adjusted against the strand directly after passing the beginning of the strand 16, but only once the upper end 17*a* has passed the rollers 5 or the beginning of the strand 16 has reached a position which is downstream of the strand guiding roller 5 by a certain distance A.

According to a further method, the amount of coolant Q delivered by the cooling nozzle 10 to the beginning region of the strand 17 is increased in dependence on a distance 11 between the beginning of the strand 16 and the cooling nozzle 10, where $0<Q<Q_{nom}$. Consequently, the beginning of the strand 16 or the beginning region of the strand 17 is cooled less intensely than the following main piece of the strand 20, the amount of coolant Q being increased to $Q_{nom}$ continuously or discretely.

Figure 3:
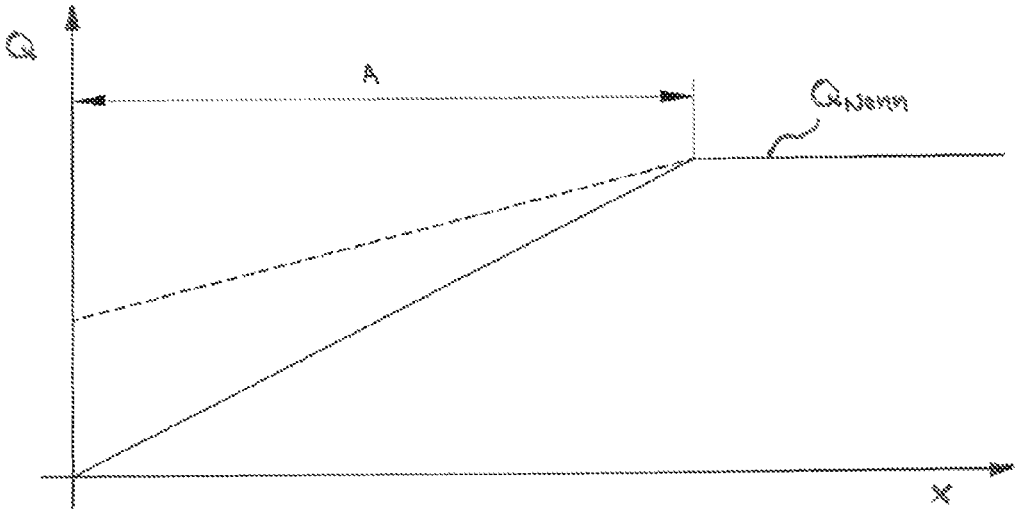
FIG. 3 shows a schematic representation of the distribution of the amount of coolant in a beginning region of the strand.

FIG. 3 shows how the amount of coolant Q delivered by a cooling nozzle 10 to the beginning region of the strand 17 with a length A is increased over the distance x (in FIG. 1*d* the reference numeral 11, x extending counter to the casting direction 9) between the beginning of the strand 16 and the cooling nozzle. The solid line indicates a distribution of the amount of coolant, the amount of coolant Q being given by the equation $$Q = \frac{Q_{nom}}{A}x.$$

By contrast with this, the distribution of the amount of coolant corresponding to the dashed line follows the equation $$Q = \frac{Q_{nom} - Q_{Min}}{A}x + Q_{Min},$$

where $Q_{min}$ indicates a minimum amount of coolant for the beginning of the strand 16.

FIGS. 2*a* to 2*f* show the method steps at the end of casting likewise for the vertical continuous casting machine for producing long products as shown in FIG. 1.

Figures 2A, 2B, 2C, 2D, 2E, 2F:
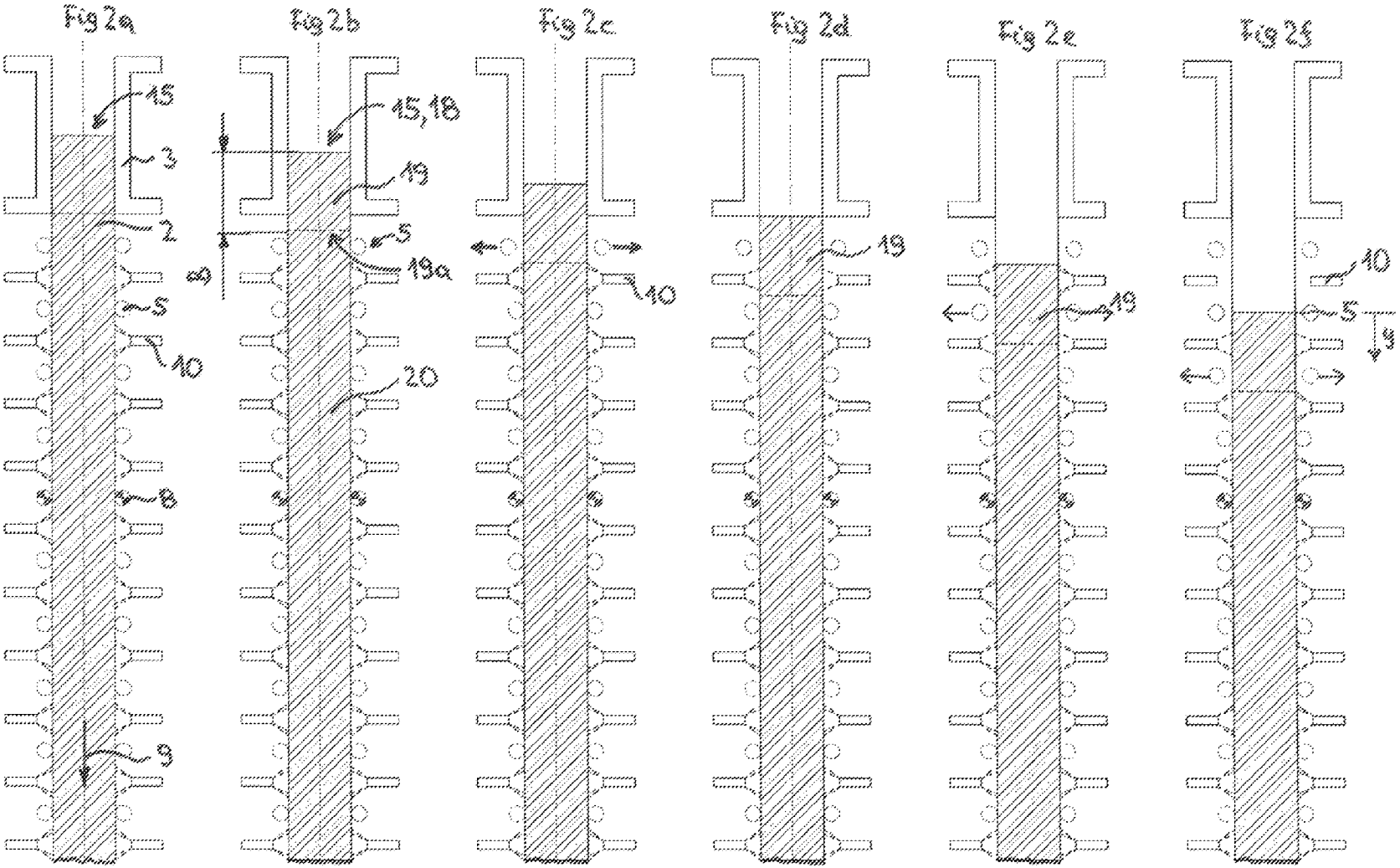
FIG. 2 shows a schematic representation of the method according to the invention at the end of casting wherein, the phases are represented in FIGS. 2*a* to 2*f;*

FIG. 2*a* shows the continuous operation of the continuous casting machine 1, all the strand guiding rollers 5, 8 of the strand guide being adjusted against the strand 2, and the strand 2 being cooled by the cooling nozzle 10 with the nominal amount of coolant $Q_{nom}$ (represented by a wide coolant jet).

FIG. 2*b* shows the stopping of the feeding of liquid steel into the mold 3, whereby the liquid metal level or the meniscus 15 falls somewhat in comparison with the stationary position of FIG. 1*a*. The cooling of the molten steel in the mold has the effect that there forms an end of the strand 18, which is followed in the casting direction 9 by the end region of the strand 19 with a length B of for example 3 m, and the main part of the strand 20 with an indeterminate length. The strand 2 continues to be withdrawn from the mold 3 in the casting direction 9, the position of the end of the strand 18 in the strand guide 4 being recorded. Since the uppermost cooling nozzles lie outside the end region of the strand 19, the cooling nozzles 10 still deliver the nominal amount of coolant $Q_{nom}$ to the strand 2.

FIG. 2*c* shows a position of the strand 2, with the uppermost roller pair being retracted from the strand 2 directly before the lower end of the end region of the strand 19*a* has passed said pair of adjustable strand guiding rollers 5, so that the pair is not touching the end region of the strand, i.e. the rollers of the pair are at a distance from the strand transversely in relation to the casting direction 9. The retraction is represented by an arrow.

FIG. 2*d* shows a further position of the strand 2, the end region of the strand 19 being cooled by the uppermost cooling nozzles 10 with a reduced amount of coolant $Q<Q_{nom}$.

FIG. 2*e* shows a further position of the strand 2 at the end of casting, the uppermost two pairs of strand guiding rollers 5 having been retracted from the strand. The second row of cooling nozzles 10 cools the end region of the strand 19 once again with a reduced amount of coolant. However, once the end of the strand 18 has already reached a position in which the end of the strand is within range of the cooling region of the uppermost row of cooling nozzles 10, the end of the strand is cooled with the maximum amount of coolant $Q=Q_{max}$.

Finally, FIG. 2*f* shows the case in which the end of the strand 18 has already passed the uppermost row of cooling nozzles 10, so that the cooling by these cooling nozzles 10 is ended. In the position shown, the third row of adjustable rollers 5 is retracted from the strand 2.

Also in the case of the method for the end of casting it is possible that, during the cooling of the end region of the strand 19, the amount of coolant Q delivered by a cooling nozzle 10 is reduced in dependence on a distance 11 between the end of the strand 18 and the cooling nozzle 10, where $0<Q<Q_{nom}$.

Figure 4:
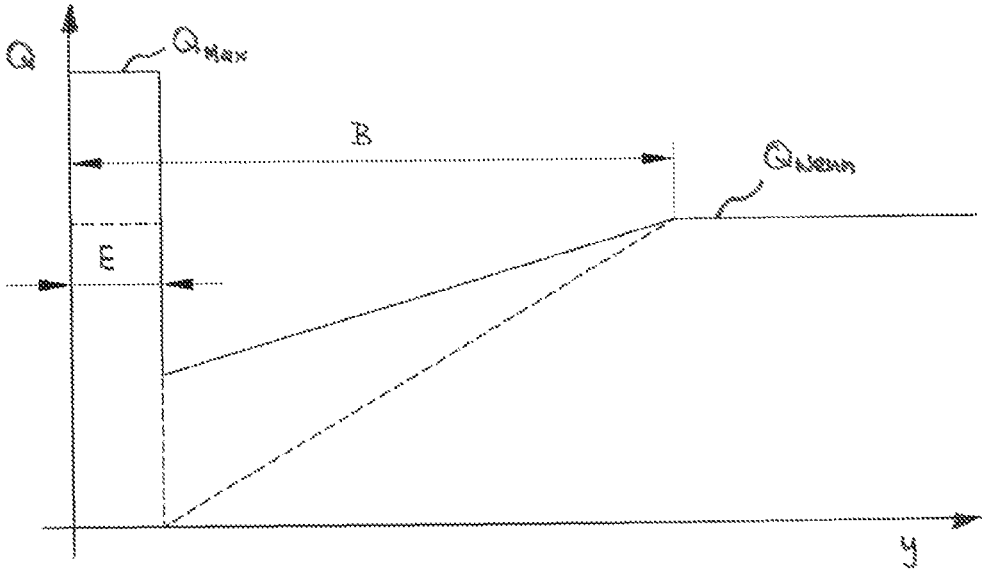
FIG. 4 shows a schematic representation of the distribution of the amount of coolant in an end region of the strand.

FIG. 4 shows how the amount of coolant Q delivered by a cooling nozzle 10 to the end region of the strand 19 with a length B and to the end of the strand 18 with a length B is set over the distance y (see FIG. 2*f*, y extending in the casting direction 9) between the end of the strand 18 and the cooling nozzle 10. The solid line indicates a distribution of the amount of coolant, the amount of coolant being $Q=Q_{max}$ for the distance $0<y<E$ and the amount of coolant being given by the equation $$Q = \frac{Q_{nom}}{2(B-E)}y$$

for the distance $E<y<B$. By contrast with this, the distribution of the amount of coolant corresponding to the dashed line is given as $Q=Q_{nom}$ for the distance $0<y<E$ and is given by the equation $$Q = \frac{Q_{nom}}{B-E}y$$

for the distance $E<y<B$.

In FIG. 5, the method for operating the continuous casting installation according to FIG. 1 when there is a temporary slowing down of the casting operation is represented.

Figures 5A, 5B, 5C, 5D, 5E, 5F:
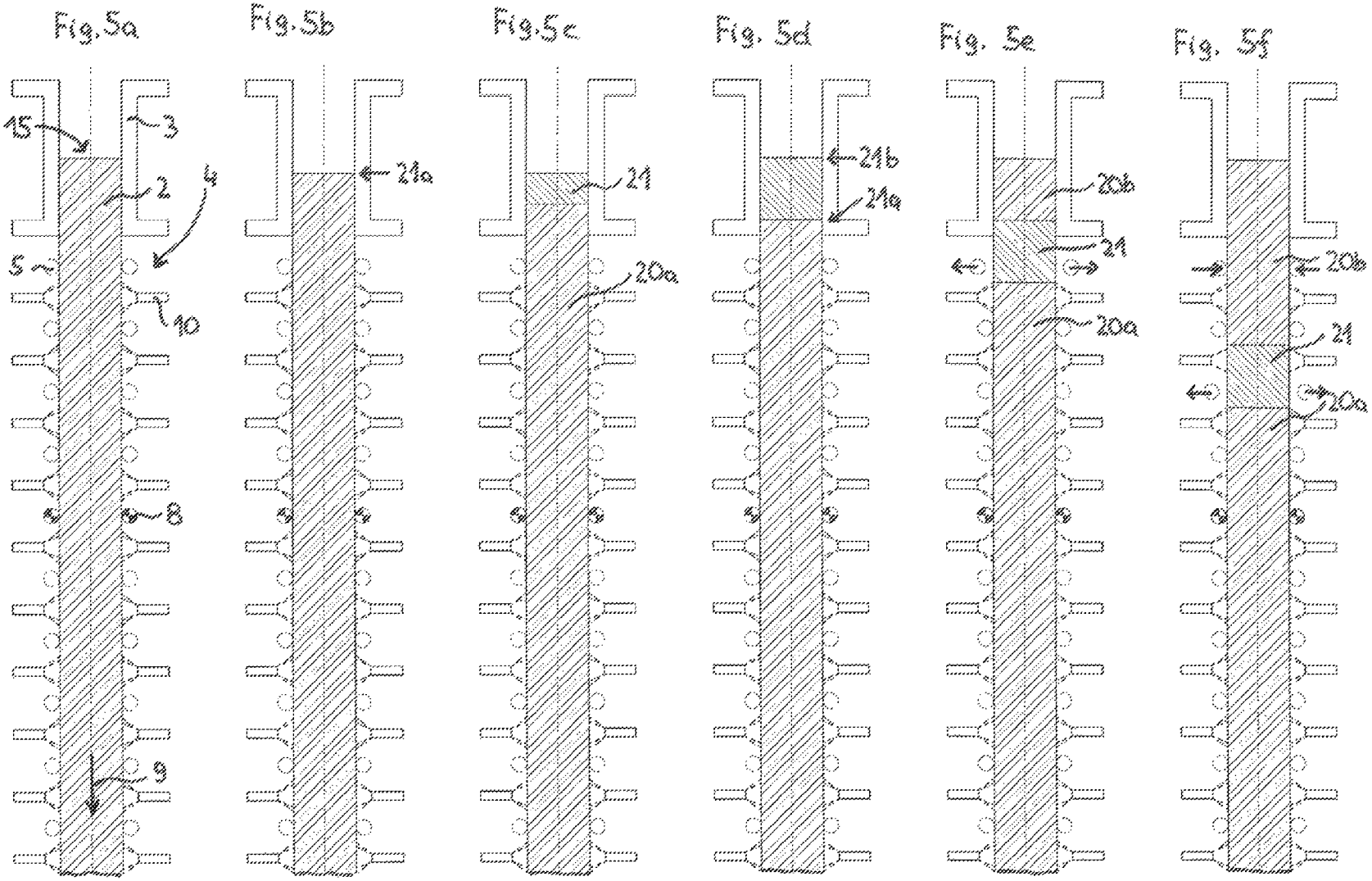
FIG. 5 shows a schematic representation of the method according to the invention when there is a temporary slowing down of the casting operation, wherein the phases are represented in FIGS. 5*a* to 5*f.*

FIG. 5*a* shows the continuous operation of the continuous casting machine, liquid steel being cast in a mold 3 to form a partially solidified strand 2 with the profile of a billet. The strand is guided in the strand guide 4 by the adjusted strand guiding rollers 5 and cooled with cooling water by the cooling nozzles 10. As this happens, the strand 2 is withdrawn continuously from the mold in the casting direction 9 at a withdrawal rate $v_{nom}$ by the drivable strand guiding rollers 8.

FIG. 5*b* shows the situation when reducing the feeding rate of liquid steel into the mold 3. Decreasing the amount of steel that is fed to the mold 3 has the effect that the meniscus 15 falls somewhat. At the same time or directly after the reduction, the strand withdrawal rate v is likewise reduced, so that $v<v_{nom}$. The reduction in the inflow rate of steel into the mold 3 or the reduction in the withdrawal rate v has the effect of initiating the formation of a transitional piece 21, the lower end 21*a* of the transitional piece being formed in FIG. 5*b*.

In FIG. 5*c*, the reduced inflow rate and the reduced withdrawal rate v of FIG. 5*b* are maintained, whereby the transitional piece 21 forms further. The part of the strand following the transitional piece in the casting direction 9 is referred to as the lower main piece of the strand 20*a*.

In FIG. 5*d*, the continuous nominal operation of the continuous casting machine 1 is reproduced, the inflow rate and the strand withdrawal rate being increased again to the nominal values. As this happens, the upper end 21*b* of the transitional piece 21 is formed, whereby the formation of the intermediate piece 21 is ended.

The positions of the upper end 21*b* and lower end 21*a* of the transitional piece 21 are recorded, for example by means of the driven strand guiding rollers 8, so that their positions can be used for the subsequent setting of the adjustable strand guiding rollers 5 and the cooling nozzles 10.

FIG. 5*e* shows how the strand 2 with the lower main piece of the strand 20*a*, the transitional piece 21 and the upper main piece of the strand 20*b*, which follows the transitional piece, is withdrawn from the mold 3 at $v_{nom}$. The uppermost pair of strand guiding rollers 5 is retracted from the strand 2 directly before the lower end 21*a* of the transitional piece 21 passes the pair 5 (represented by arrows), so that the rollers of the pair 5 are not touching the transitional piece 21. As a result, the transitional piece 21 is cooled less intensely by the cooled strand guiding rollers 5 than the main pieces of the strand 20*a*, 20*b*. The uppermost pair of cooling nozzles 10 cools the lower main piece of the strand 20*a* of the strand 2 with an amount of coolant $Q=Q_{nom}$.

FIG. 5*f* shows a further situation when producing the transitional piece 21. The strand 2 is withdrawn further, the uppermost pair of strand guiding rollers having been adjusted again against the strand 2 or the upper main piece of the strand 20*b*. The second pair of strand guiding rollers has also already run through this sequence of retraction from the strand and readjustment against the strand. The uppermost pair of cooling nozzles 10 has also run through a sequence in which the lower and upper main pieces of the strand 20*a*, 20*b* have been cooled with $Q=Q_{nom}$ and the transitional piece 21 lying inbetween has been cooled with $Q<Q_{nom}$. In the figure, a reduced amount of coolant is represented by a thinner coolant jet. The third pair of rollers 5 was retracted from the strand before the lower end 21*a* of the transitional piece 21 passed the rollers, so that the rollers are not touching the transitional piece 21. In FIG. 5*f*, the transitional piece 21 is cooled by the second pair of cooling nozzles 10 with an amount of coolant $Q<Q_{nom}$.

Consequently, the adjustable strand guiding rollers 5 are moved in a way corresponding to the position of the transitional piece 21, so that the rollers are not touching the transitional piece 21. The retraction may take place either directly before the passing of the lower end 21*a*, or already a few meters before the actual passing. By analogy with this, the adjustment of the pair of rollers 5 may take place either directly after the passing of the upper end 21*b* of the transitional piece, or only a few meters after the actual passing of the transitional piece 21.

Although the invention has been represented in the exemplary embodiments for a vertical continuous casting machine, the invention is not in any way restricted to this. Rather, it can be used without restriction for vertical, bow-type and horizontal continuous casting machines. In the case of bow-type machines, however, it must be noted that the distance between two elements (for example an end of the strand and a cooling nozzle) is given by the arc length of a neutral axis of the strand between these elements.

Although the invention has been more specifically illustrated and described in detail by the preferred exemplary embodiments, the invention is thus not restricted by the disclosed examples, and other variations can be derived from them by a person skilled in the art without departing from the protective scope of the invention.

LIST OF DESIGNATIONS

1 continuous casting machine
2 strand
3 mold
4 strand guide
5 adjustable strand guiding roller
6 dummy bar
7 dummy bar head
8 drivable strand guiding roller
9 casting direction
10 cooling nozzle
11 distance
15 meniscus
16 beginning of the strand, lower end of the beginning region of the strand
17 beginning region of the strand
17*a* upper end of the beginning region of the strand
18 end of the strand
19 end region of the strand
19*a* lower end of the end region of the strand
20 main part of the strand
20*a* lower main part of the strand
20*b* upper main part of the strand
21 transitional piece
21*a* lower end of the transitional piece
21*b* upper end of the transitional piece
A length
Q amount of coolant
$Q_{nom}$ nominal amount of coolant
$Q_{min}$ minimum amount of coolant
$Q_{max}$ maximum amount of coolant
x,y distance

The invention claimed is:

1. A method for operating a continuous casting machine at the start of casting, wherein the continuous casting machine comprises a mold;

a strand guide comprising at least one pair of adjustable strand guiding rollers and at least one cooling nozzle;

the method comprises the steps in sequence of:

introducing a dummy bar with a dummy bar head into the continuous casting machine;

holding the dummy bar in the strand guide, wherein the dummy bar head is located and configured for closing off the mold in a fluid-tight manner;

starting casting using the continuous casting machine, comprising pouring liquid steel into the mold forming an at least partially solidified strand comprising in a casting direction: a beginning of the strand, a following beginning region of the strand with a length A, $0.5<A<5$ m, and thereafter a main part of the strand; and then withdrawing the dummy bar from the mold in the casting direction;

recording a position of the beginning of the strand in the strand guide;

after the beginning of the strand, permitting an upper end of the beginning region of the strand to pass the pair of adjustable strand guiding rollers;

then adjusting the pair of rollers for touching the strand;

cooling the beginning region of the strand with $Q<Q_{nom}$, wherein a cooling nozzle is located and configured for delivering an amount of coolant Q that is less than a nominal amount of coolant $Q_{nom}$ to the beginning region of the strand; and cooling the main part of the strand with $Q\approx Q_{nom}$ by the cooling nozzle delivering an amount of coolant Q that is substantially equal to $Q_{nom}$ to the main part of the strand.

2. The method as claimed in claim 1, further comprising increasing the amount of coolant Q delivered by the cooling nozzle to the beginning region of the strand in dependence on a distance between the beginning of the strand and the cooling nozzle.

3. The method as claimed in claim 1, further comprising reducing a thickness of the strand by adjusting the pair of adjustable strand guiding rollers against the strand.

4. The method as claimed in claim 3, wherein the strand has a liquid core during the reduction of its thickness.

5. A method for operating a continuous casting machine at the end of casting, wherein the continuous casting machine comprises:

a mold, a strand guide comprising at least one pair of adjustable strand guiding rollers and at least one cooling nozzle;

the method comprising the steps in sequence:

continuously casting a strand by casting liquid steel in the mold to form an at least partially solidified strand;

stopping the feeding of liquid steel into the mold and forming an end of the strand in the mold, so that the strand has an end, forming a following end region of the strand with a length B, $0.5<B<5$ m, and thereafter forming a main part of the strand;

withdrawing the strand from the mold in a casting direction;

recording a position of the end of the strand in the strand guide;

before the end of the strand, passing a lower end of the end region of the strand, past the pair of adjustable strand guiding rollers;

then retracting the pair of adjustable strand guiding rollers, so that the pair of guiding rollers is not touching the strand;

cooling the main part of the strand with $Q\approx Q_{nom}$, with the cooling nozzle delivering an amount of coolant Q that is substantially equal to a nominal amount of coolant $Q_{nom}$ to the main part of the strand;

cooling the end region of the strand with $Q<Q_{nom}$, by delivering an amount of coolant $Q<Q_{nom}$ to the end region of the strand by the cooling nozzle; and cooling the end of the strand with $Q\geq Q_{nom}$, by delivering an amount of coolant $Q\geq Q_{nom}$ to the end of the strand by the cooling nozzle.

6. The method as claimed in claim 5, further comprising during the cooling of the end region of the strand, reducing the amount of coolant Q delivered by the cooling nozzle in dependence on a distance between the end of the strand and the cooling nozzle.

7. The method as claimed in claim 5, further comprising during the cooling of the end of the strand, delivering a maximum amount of coolant $Q=Q_{max}$ to the strand by the cooling nozzle.

8. The method as claimed in claim 5, further comprising once the end of the strand has passed the cooling nozzle, ending the cooling by the cooling nozzle.

9. A method for operating a continuous casting machine when there is a temporary slowing down of the casting operation, wherein the continuous casting machine comprises:

a mold, a strand guide comprising at least one pair of adjustable strand guiding rollers and at least one cooling nozzle;

the method comprising in sequence:

continuously casting a strand, by casting liquid steel in the mold to form an at least partially solidified strand;

withdrawing the strand from the mold at a rate v, in a casting direction with v substantially equal to a nominal rate $v_{nom}$;

reducing a feeding rate of liquid steel into the mold for forming a transitional piece;

withdrawing the strand at $v<v_{nom}$;

increasing the feeding rate of liquid steel into the mold ending the formation of the transitional piece for providing the strand with a lower main part of the strand, the transitional piece and an upper main part of the strand;

withdrawing the strand at $v \approx v_{nom}$;

recording the positions of a lower end and an upper end of the transitional piece in the strand guide;

before the lower end of the transitional piece has passed the pair of adjustable strand guiding rollers, retracting the pair of adjustable strand guiding rollers from the strand, so that the roller pair is not touching the transitional piece;

once the upper end of the transitional piece has passed the pair of adjustable strand guiding rollers, adjusting the pair of adjustable strand guiding rollers against the strand, so that the roller pair is touching the strand;

cooling a main part of the strand with $Q \approx Q_{nom}$, by the cooling nozzle delivering an amount of coolant Q that is substantially equal to a nominal amount of coolant Qnom to the main part of the strand; and cooling the transitional piece with $Q<Q_{nom}$, by the cooling nozzle delivering an amount of coolant $Q<Q_{nom}$ to the transitional piece.

* * * * *